US005718476A

United States Patent [19]

De Pascal et al.

[11] Patent Number: 5,718,476

[45] Date of Patent: Feb. 17, 1998

[54] SEAT WITH ADJUSTABLE LUMBAR SUPPORT

[75] Inventors: Hugues De Pascal, Romans sur Isere; Serge Raibaldi, Chatte, both of France

[73] Assignee: Chairtech, Saint Marcellin, France

[21] Appl. No.: 717,426

[22] Filed: Sep. 20, 1996

[30] Foreign Application Priority Data

Sep. 21, 1995 [FR] France ..... 95 11244

[51] Int. Cl.[6] ..... A47C 3/025

[52] U.S. Cl. ..... 297/284.4; 297/284.1

[58] Field of Search ..... 297/284.4, 284.7, 297/284.8, 284.3, 284.1, 452.3, 452.31

[56] References Cited

U.S. PATENT DOCUMENTS

| | | | |
|---|---|---|---|
| 3,990,742 | 11/1976 | Glasset et al. | 297/284.3 |
| 4,730,871 | 3/1988 | Sheldon | 297/284.7 |
| 5,316,371 | 5/1994 | Bishai | 297/284.1 X |
| 5,419,614 | 5/1995 | Richards et al. | 297/284.4 X |
| 5,567,010 | 10/1996 | Sparks | 297/284.4 |

FOREIGN PATENT DOCUMENTS

| | | |
|---|---|---|
| A-2541559 | 3/1977 | Germany . |
| C-4211094 | 6/1993 | Germany . |
| A-1399285 | 7/1975 | United Kingdom . |

*Primary Examiner*—Milton Nelson, Jr.

*Attorney, Agent, or Firm*—Fay, Sharpe, Beall, Fagan, Minnich & McKee

[57] ABSTRACT

An office chair has a seat (6) supported by a base (2). A seat back (7) is resiliently attached to the seat. A pair of axles (36*a*, 36*b*) support upper cams (31*a*, 32*a*) and lower cams (31*b*, 32*b*), respectively. A stiff, flexible sheet (20) is attached (210) to the seat back and extends over and is supported by the upper and lower cams. As a mechanical linkage which interconnects the cams with each other and an operator controlled knob (500) coordinately rotates the cams, the curvature of the flexible sheet (20) continuously changes its contour. More specifically, the contour flows such that a salient point (S) of maximum contact with the lumbar region of the user shifts in a vertical direction (h) and in a horizontal direction (e) simultaneously and concurrently.

8 Claims, 6 Drawing Sheets

SEAT WITH ADJUSTABLE LUMBAR SUPPORT

BACKGROUND OF THE INVENTION

The present invention consists of a chair, particularly an office chair, constituted by a seat held by a base and a seatback immovably attached to the said seat. The invention is more particularly related to an improvement for the seatback.

The seatback presently exists in a number of types of chairs, such as those used in offices which include a seat held by a support, a metallic base for example, and a seatback permitting a user to be able to rest his back, and thus be able to work in good conditions.

In order to improve the ergonomics of chairs, an adjustable lumbar support device is occasionally foreseen, which is installed on a seatback which offers a user the possibility of obtaining a good support for the lumbar part of the spine, the region of the back particularly sensible to the harmful effects of being in a prolonged sitting position.

The present adjustable lumbar support devices are generally constituted by either an adjustment of the height of the support zone, or an adjustment of its depth. Chairs also exist which consist of two adjustments, but those are independent and thus consist of two independent commands.

However, these well-known adjustment devices present a number of inconveniences; on one hand, the fact that the user must work with two different controls which represent a complex operation, and on the other hand, the difficulty of obtaining the optimal support which can only be attained through numerous operations of successive experimentation on one or more adjustment commands, moreover, without assurance of a final result.

SUMMARY OF THE INVENTION

The subject of the present invention resolves the technical problem by suggesting a chair, particularly an office chair, constituted by a seat held by a base, and a seatback immovably attached to the said seat, the said seatback consisting of an adjustable lumbar support device; a chair in which the said adjustable lumbar support device would be of a lot more simple handling than with the present well-known devices, and which offers the best support possible.

According to the present invention, the solution to the technical problem posed is that the said adjustable lumbar support device includes the means of simultaneous and continuous adjustment of height and depth of the position of a salient point of contact with the lumbar region of a user.

Thus, the positioning of the said salient point of contact can be adjusted by a sole movement obtained with the aid of a unique command. The handling of the chair is found to be, therefore, particularly simplified. Furthermore, the curve described by the salient point at the time of acting upon the said means of adjustment is intended to leave the precise anatomical elements in a way to assure a lumbar support as satisfying as possible whatever the morphology of the users.

According to a particular method of achievement, the said means of adjustment comprises at least a pair of aligned cams parallel to the axle of the seatback and on which a flexible headboard, fixed to the said seatback and holding the said prominent point of contact, is supported by elastic support, the said cams being moved back and forth, one connected to the other, and able to be placed simultaneously and continuously in rotation with the help of a control device.

Other characteristics and advantages of the invention will become apparent from the description which follows in viewing the attached drawings which are given only as examples and not for limitation.

Figure 1:
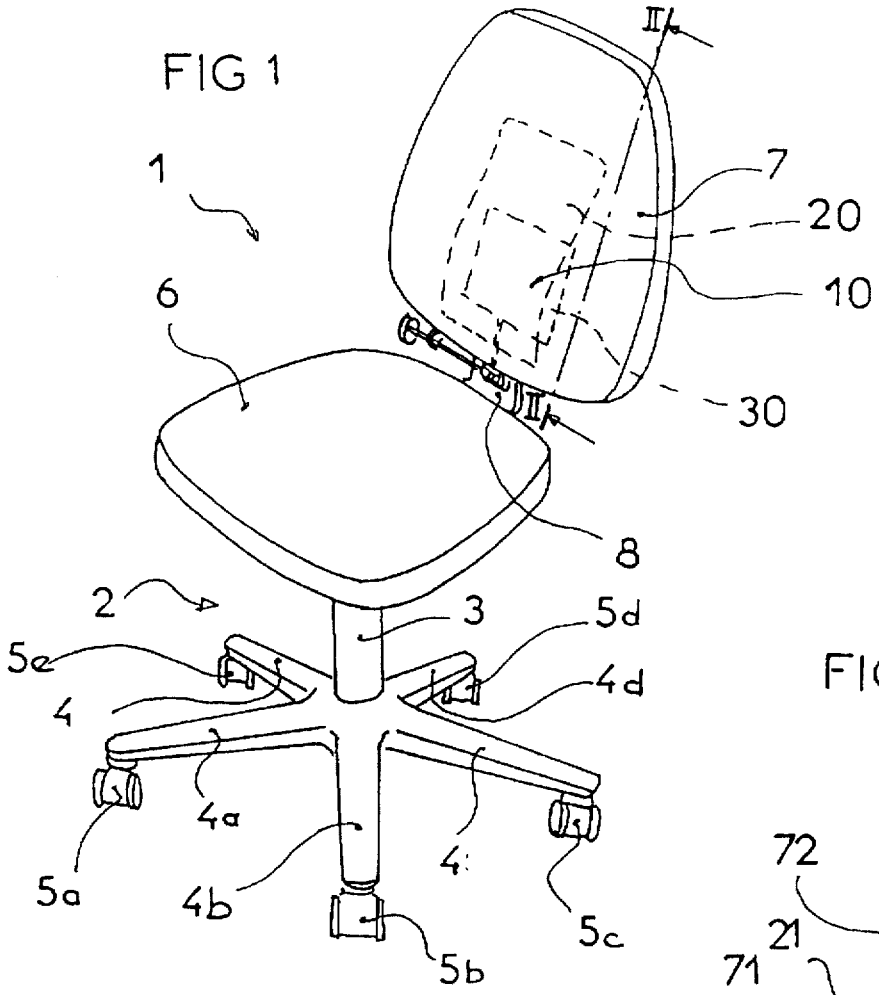
FIG. 1 is a general perspective view of a chair in a position of use according to the invention and given only as an example.

The chair, shown by way of example in FIG. 1, consists of a foundation assembly (1) supported by a base (2). The latter, illustrated by example, includes a vertical tube (3) including at its lower part and forming the base, five lateral extensions (4*a*, 4*b*, 4*c*, 4*d*, 4*e*) each holding at its end a wheel (5*a*, 5*b*, 5*c*, 5*d*, 5*e*) allowing for the movement of the chair. The foundation assembly (1) is constituted by a seat (6) and a seatback (7). The said seat (6) being attached to the base, while the said seatback (7) is directly and immovably attached to the seat, connected to it by a connecting piece (8) as illustrated. It is understood that, in a variation, the seatback can also be directly connected to the base. The said connecting piece also being able to be adjusted and including elastic means allowing the adjustment of the slant of the seatback in such a way that its elastic mobility is necessary for the comfort of the chair.

DETAILED DESCRIPTION OF THE PREFERRED EMBODIMENTS

The chair shown in FIG. 1 consists, as well, of a lumbar support adjustment device (10) which will now be described in detail with reference to the FIGURES. The seatback (7) is constituted by an assembly of several elements; a subset of the seatback (7*a*) constituted by a seatback plate (70) on which is fixed a headboard (20), which we will return to later, covered by a seatback padding (71), then a seatback assembly (72), and a seatback casing (7*b*). The seatback plate (70) is, for example, made of strips of wood glued together to assure the mechanical control of the seatback and presents an adaptable geometry and anatomical form. The padding (71) forming the cushion is, for example, made of a polyethylene or polyurethane bendable foam to assure the comfort of the chair. The padding (71) is advantageously covered with the seatback assembly (72) in fabric or velvet or another appropriate material. The seatback casing assuring the finish of the seatback is made of an injected plastic material, thermally molded or other, and is advantageously fixed, for example, with clips to the seatback plate (70).

Figure 2:
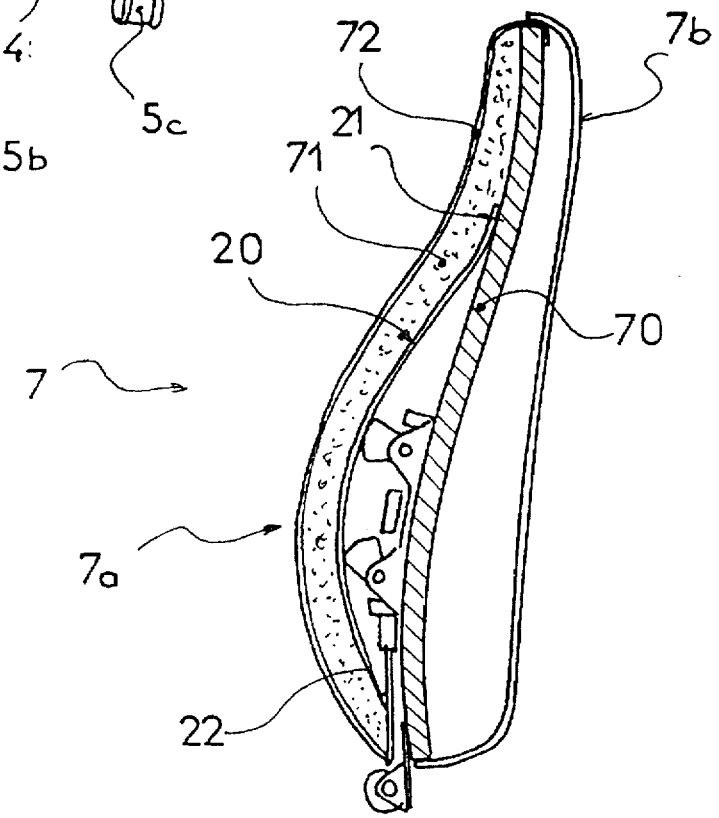
FIG. 2 is a schematic view of the seatback in accordance with the vertical surface II—II.
Figure 3:
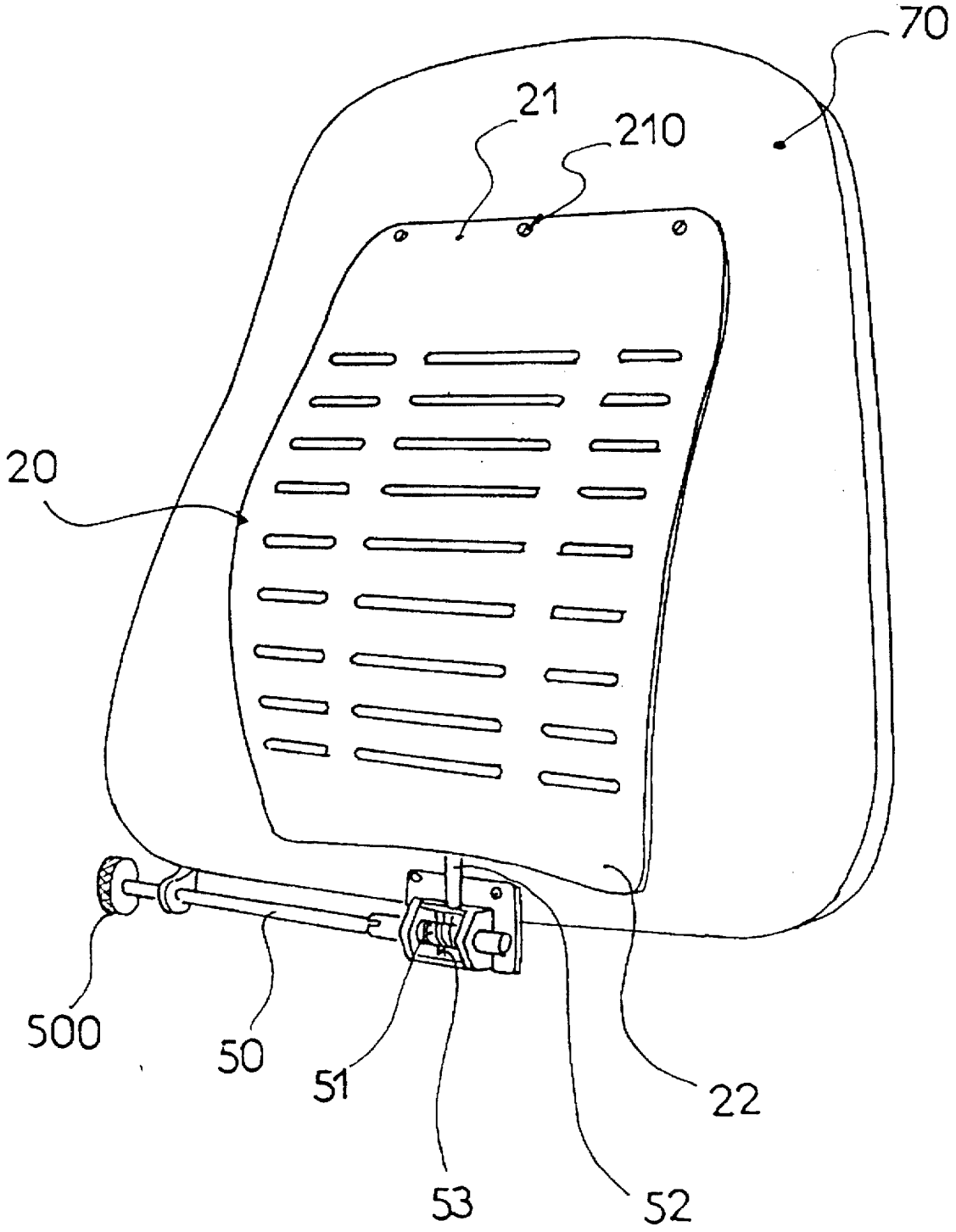
FIG. 3 is a perspective view of the seatback of the chair in FIG. 1 equipped with a lumbar support device conforming to the invention, the assembly having been withdrawn.

As seen more particularly in FIG. 2, the said adjustable lumbar support device (10) includes a flexible headboard (20) fixed to the seatback (7) and more precisely to the seatback plate (70) which, in this example, is constituted by a flexible plate of plastic material which has been hem-stitched to make it semi-rigid and covers the adjustment means. The said plate is fixed to the seatback plate (70) by its upper end (21) by screws, hooks or glue (210), while its lower end (22) is free. It is obvious that another arrangement may be adopted, as, for example, a floating assembly which would not be fixed to the seatback plate.

Thus, to show FIGS. 6*a* to 6*f* more precisely, the said headboard (20) presents a salient zone or point of contact (S) which corresponds geometrically to the headboard's most advanced point in thickness and around which is extended a zone which contacts with the lumbar region of the user when the user leans against the seatback (7).

In accordance with the illustrations, the said adjustable lumbar support device (10) consists equally of means with which to simultaneously and continuously adjust the height and depth of the position of the said salient point of contact (S).

Figure 4:
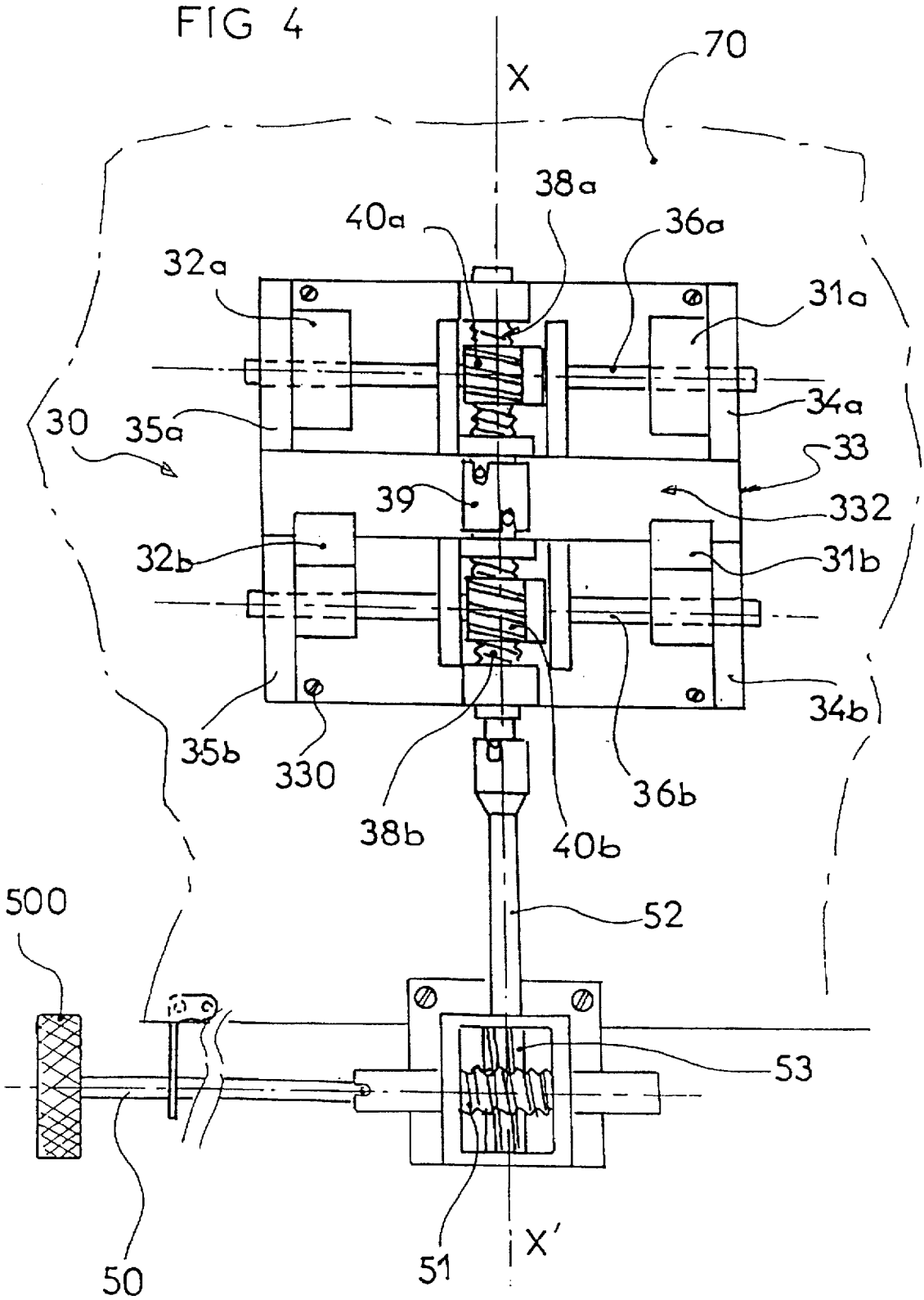
FIG. 4 is a frontal view of a method of achievement of the adjustment means of the device of FIGS. 1, 2, and 3.
Figure 5:
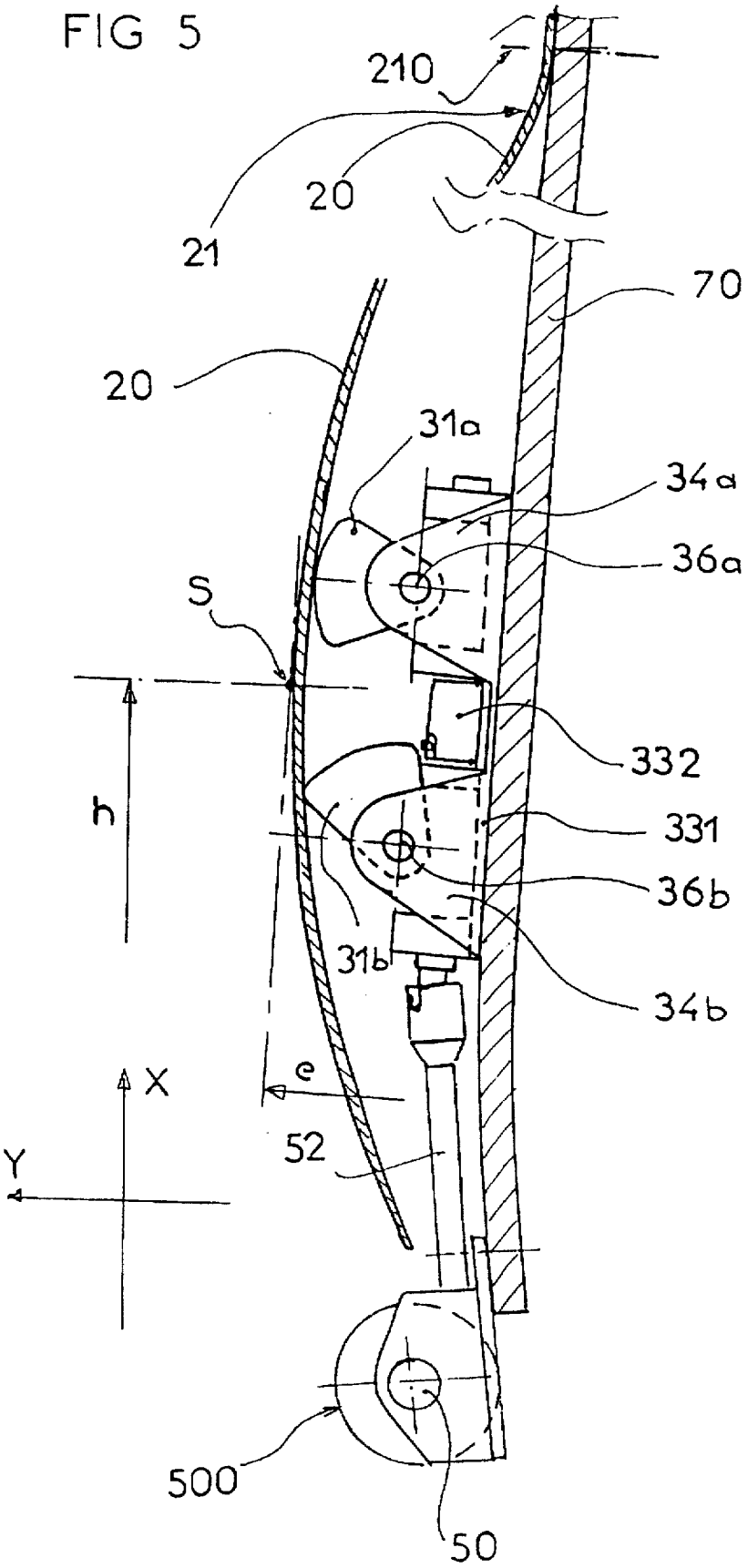
FIG. 5 is a lateral view of the device as illustrated in FIG. 4.
Figure 6A:
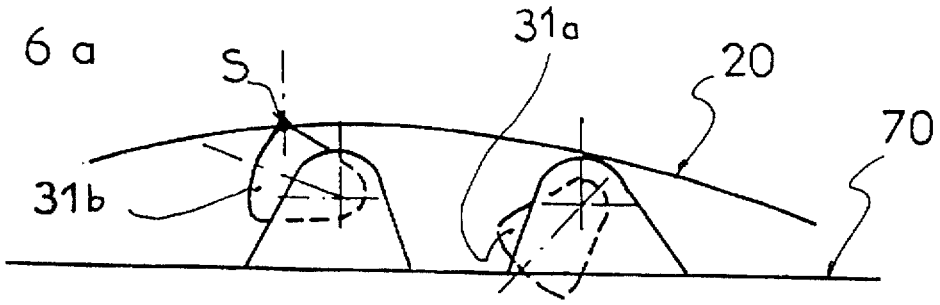
FIGS. 6*a* to 6*f* show, on the diagrams, a side view of different positions of the adjustment means
Figure 6B:
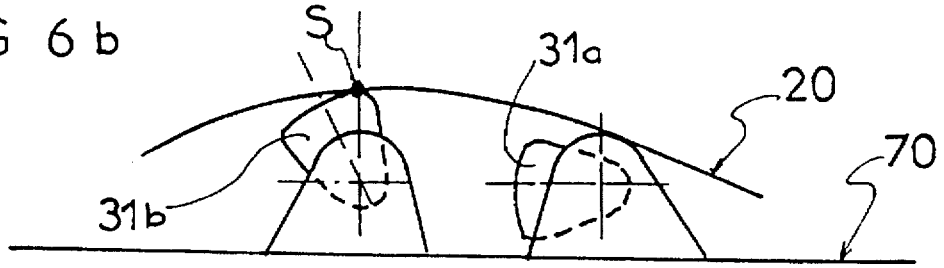
Figure 6C:
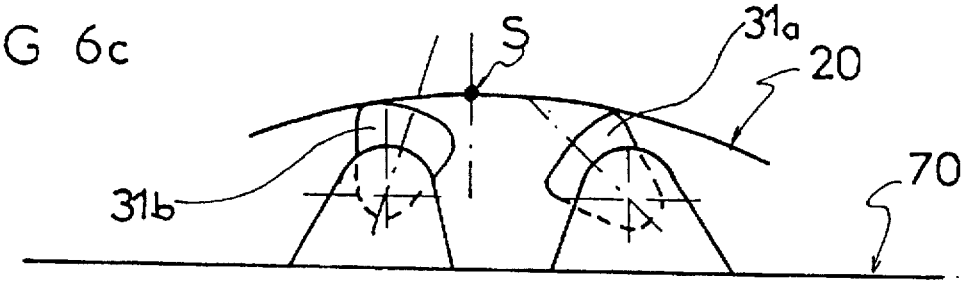
Figure 6D:
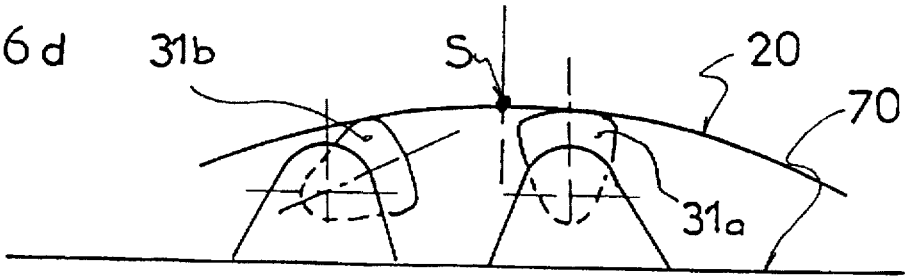
Figure 6E:
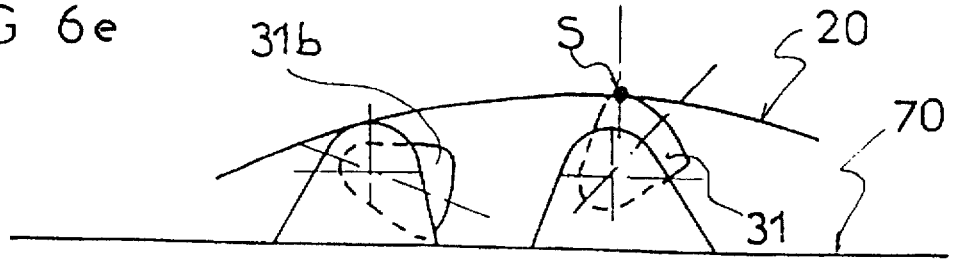
Figure 6F:
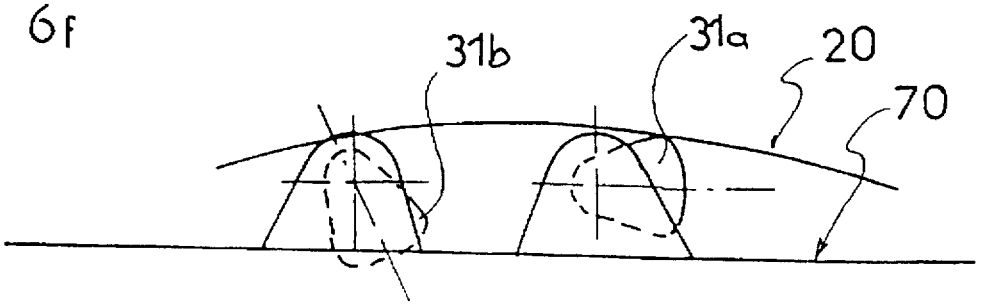

These adjustment means (30), evident in FIGS. 1 and 2, are shown in more detail in FIGS. 4 and 5.

As the aforementioned FIGURES illustrate, the said adjustment means includes at least a pair of cams, pivotly disposed on a plate fixed to the support plate (70).

In the preferred method of achievement, the adjustment means are constituted by two pairs of cams, a first pair (31*a*, 31*b*), on one hand, and a second pair (32*a*, 32*b*), on the other hand. The cams of each pair are aligned parallel to the axis (XX') of the seatback (7). The respective dimensions of the said cams and the flexible plate (20) are such that the latter is always held in support against at least one of the cams of each pair, as one can see in FIGS. 6*a* to 6*f*.

The cams (31*a*, 31*b*, 32*a*, 32*b*) are rising in rotation on a plate (33) through the intermediary of braces (34*a*, 34*b*, 35*a*, 35*b*) forming treads each presenting a hole for the respective passage of the axles (36*a*, 36*b*) of the said cams. The plate (33) itself is fixed to the seatback plate (70) of the chair by any means of attachment, such as screws (330).

Note that the first pair of cams (31*a*, 31*b*) is symmetrically situated to the second pair of cams (32*a*, 32*b*) in relation to the vertical surface of general symmetry (XX') of the seatback.

Moreover, the first axle (36*a*) or upper axle holds the upper cams (31*a*, 32*a*) of the two pairs of cams, while the second axle (36*b*) or lower axle holds the lower cams (31*b*, 32*b*) of the two pairs of cams. The two axles (36*a*, 36*b*) extend horizontally and are parallel to each other.

Also note that the base (331) of the plate (33), for example, is made of plastic material and includes in its median part a zone of lesser thickness (332), the interest of which will be explained further in the description with regard to FIG. 7.

Figure 7:
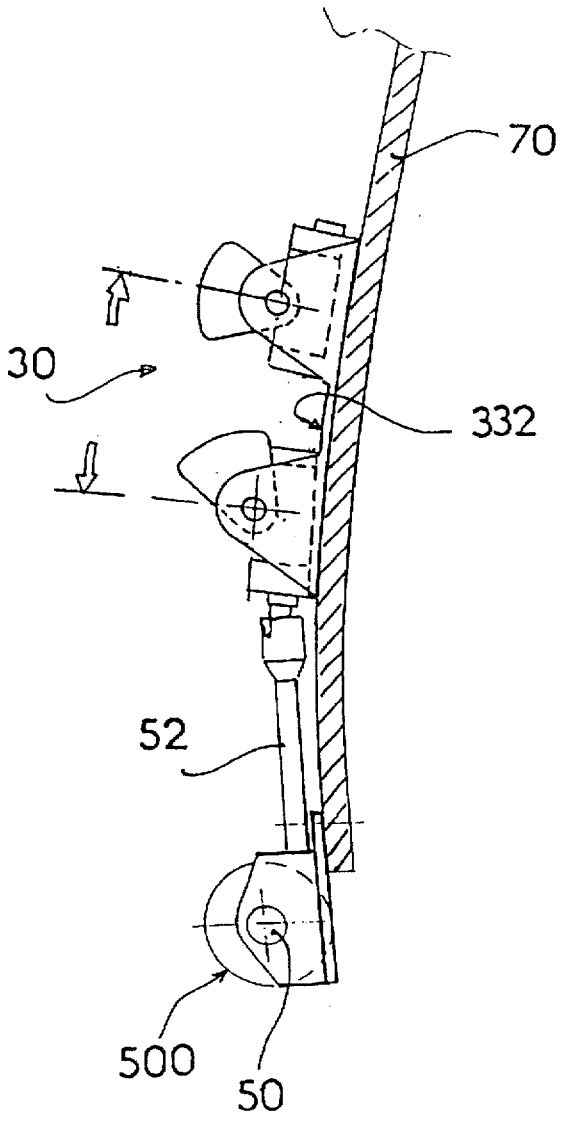
FIG. 7 is a view similar to FIG. 5, but to another scale, and illustrates an assembly on a curved seatback.

The cams (31*a*, 31*b*, 32*a*, 32*b*) are likely to be placed simultaneously and continuously in rotation with the help of a control device including two endless screws (38*a*, 38*b*) coupled together axially one to the other by a connection (39) like, for example, a universal joint, this type of coupling being particularly advantageous because it permits the detection of defects in alignment of the two endless screws, and, particularly, it permits the assembly of a plate (33) onto a curved seatback plate, as it appears in FIG. 7.

The endless screws (38*a*, 38*b*) are capable of driving respectively the helical wheels (40*a*, 40*b*) which are immovably attached to their respective axles (36*a*, 36*b*).

One then understands that by a unique movement of rotation the cams will be able to be placed simultaneously in rotation in a continuous manner.

In the example of the illustrated achievement, the said unique movement of rotation is provided by a rod of operation (50) transversely disposed to the seatback axle (7) and equipped with an endless screw (51) capable of driving into rotation through the intermediary of a helical wheel (53) an axle (52) coupled coaxially to the first of the endless screws (38*b*).

Figure 8:
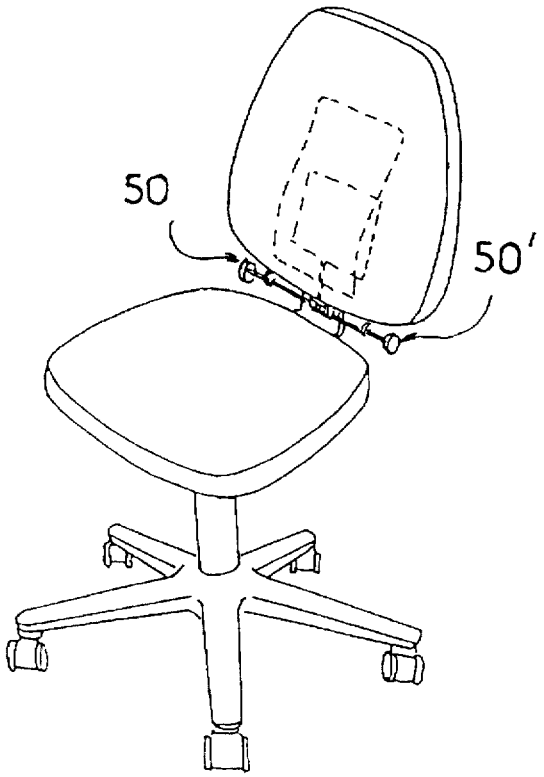
FIG. 8. is a view similar to FIG. 1 showing a variation of execution.

For the user, the adjustment of the lumbar support is completed simply by activating the rod of operation (50) into rotation until obtaining the position in which the user is most comfortable. The operation is done, for example, through the intermediary of the operation button (500). Adding that the axle of the command rod is advantageously perpendicular to the vertical surface (XX') of the general symmetry of the seatback. The said rod is disposed in an intermediary zone between the seat and seatback. The rod extends toward the right as shown in FIGS. 1 to 7, but in could be, for example, extended toward the left. Moreover, one could also have a transverse command rod (50) extending to the left and to the right at the same time as a result of the device having two adjustment buttons (50, 50'), as illustrated in FIG. 8.

In the course of the rotation of the operation rod, the cams (31*a*, 31*b*, 32*a*, 32*b*) are driven into rotation around their respective axles, which has the effect, as shown in FIGS. 6*a* to 6*f*, of shifting the salient point of contact (S) as a result of the gap between the cams.

The position of the said salient point of contact (S) can be adjusted in height (h), in accordance with the direction shown by the arrow (X) in FIG. 5, and in depth (e), in accordance with the direction shown by the arrow (Y), at the same time. The curve described by the salient point (S) is determined by the best compromise in height and in depth, in view of the average anatomy of the user.

FIG. 7 illustrates the interest of the zone of lesser thickness (332) achieved on the plate. In fact, thanks to the possible distortion of the base (331), the plate could be fixed to seatback plates other than on plate surfaces, and, particularly, curves, and, for example, convexes, as shown.

To add and clarify, the adjustment device of the invention permits a continuous and unending movement of the components, which presents the advantage of not being required to stop the end of the rotation because the user need only operate the button, in one sense or another, to find his preferred position.

It is understood that the invention is not limited to the methods of achievement described and shown in the examples, but also includes equivalent techniques as well as their combinations.

We claim:

1. An office chair comprising:

a seat held by a base;

a seatback immovably attached to the said seat, the said seatback including a lumbar support adjustment device for simultaneously and continuously adjusting height and depth of a position of a salient point of contact with a lumbar region of a user, said lumbar support adjusting device including:

at least a pair of aligned cams parallel to an axis of the seatback;

a flexible sheet supported by the cams, fixed to the said seatback, and holding the said salient point of contact; and a control device for rotating said cams back and forth one in relation to the other simultaneously and continuously.

2. The chair according to claim 1 wherein said adjustment device includes two pairs of cams laterally disposed in relation to each other on a plate fixed to the said seatback, said pairs of cams being simultaneously and continuously placed in rotation with a control device.

3. The chair according to claim 1 wherein said control device includes two endless screws coupled together axially one to the other, each driving a helical wheel immovably attached to one of the said cams to rotate.

4. The chair according to claim 3 wherein said endless screws are flexibly coupled together axially by a universal joint.

5. The chair according to claim 3 wherein said control device includes a rod for driving an axle which is coupled axially to one of the said endless screws to rotate.

6. The chair according to claim 5 wherein said rod is transversely disposed to the axis of the seatback (7) and is equipped with a worm gear for rotating a helical wheel which is coupled to the said axle.

7. A chair with adjustable lumbar support, the chair comprising:

a seat supported by a base;

a seat back attached to the seat; and, an adjustable lumbar support mounted to the seat back, the adjustable lumbar support including:

a handle which is rotated by an operator to adjust lumbar support;

at least one lower cam segment mounted to a horizontally mounted axle for rotation therewith;

an upper cam segment mounted to a second horizontally disposed axle for rotation therewith;

a mechanical transmission connecting the handle, the lower axle, and the upper axle such that movement of the handle causes coordinated rotation of the upper and lower cam segments;

a resilient sheet supported by the seat back and extending between the upper and lower cam segments and an operator seated in the chair such that as the upper and lower cam segments rotate, the upper and lower cam segments contact the resilient sheet at upper and lower points causing the resilient sheet to deflect along a smooth curve, which smooth curve defines a salient point of maximum extension from the seat back, coordinated rotation of the upper and lower cam segments both shift the salient point in a vertical direction and adjust an amount of extension of the salient point from the seat back.

8. A method of adjusting lumbar support of a chair whose seat back includes a stiff flexible sheet which is flexed over and supported by upper and lower cam segments, the method comprising:

coordinately rotating the upper and lower cam segments, the coordinated rotation of the upper and lower cam segments changing a curvature of the flexible sheet such that a salient point of contact with a lumbar region of a user is simultaneously adjusted (1) vertically relative to the seat back and (2) horizontally toward and away from the seat back.

* * * * *